United States Patent [19]

Lochel, Jr.

[11] 4,264,653

[45] Apr. 28, 1981

[54] COATING OF STEEL

[75] Inventor: Frank P. Lochel, Jr., York County, S.C.

[73] Assignee: Pennwalt Corporation, Philadelphia, Pa.

[21] Appl. No.: 78,365

[22] Filed: Sep. 24, 1979

[51] Int. Cl.[3] ..... C23F 11/00

[52] U.S. Cl. ..... 427/318; 106/14.27; 252/48.2; 252/52 R; 427/309

[58] Field of Search ..... 106/14.27; 252/48.2, 252/52 R, 33.4, 34.7, 42.4; 427/309, 318

[56] References Cited

U.S. PATENT DOCUMENTS

| | | | |
|---|---|---|---|
| 2,254,756 | 9/1941 | Segessemann | 252/48.2 |
| 2,409,726 | 10/1946 | Winning et al. | 252/52 R |
| 2,962,401 | 11/1960 | Guminski | 252/52 R |
| 3,765,955 | 10/1973 | Kushima et al. | 148/31.5 |
| 3,855,136 | 12/1974 | McDole et al. | 252/52 R |
| 3,857,789 | 12/1974 | Krupin et al. | 252/33.4 |
| 4,073,736 | 2/1978 | Schick et al. | 252/48.2 |

OTHER PUBLICATIONS

Walker et al., Slushing Oils, Technologic Papers of the Bureau of Standards, No. 176, Oct. 14, 1920, p. 13.

*Primary Examiner*—Ralph S. Kendall
*Attorney, Agent, or Firm*—Robert G. Danehower

[57] ABSTRACT

A process for coating steel with a non-dripping pickle oil is disclosed. The coating process uses a heated hydrocarbon oil containing a long-chain linear alcohol as the coating medium. The alcohol converts the hydrocarbon oil into a meso-solid at ambient temperatures. The coating provides corrosion protection for the steel during storage and shipping. The process is also applicable for converting slushing oils and oils for drawing and stamping of metal into meso-solid coatings.

6 Claims, No Drawings

COATING OF STEEL

BACKGROUND OF THE INVENTION

Steel strip, as it leaves a hot rolling mill, is covered with iron oxide mill scale. These iron oxides are removed by passing the steel strip through a mechanical descaler followed by immersion in a pickle tank where it is contacted by hot hydrochloric or sulfuric acid which removes the oxides.

Steel strip as it leaves the pickle tank will be at a temperature of about 160° to 180° F. and the surface of the steel will be extremely reactive so that it must be coated immediately with a pickle oil to prevent reoxidation.

The pickle oils used in the steel mills today are light hydrocarbon oils containing a substantial quantity of grease. These light pickle oils have three disadvantages. First, they drip from the coiled steel strip creating a fire and accident hazard on the floor of the steel mill. Secondly, as the pickle oil is depleted from the steel strip, its ability to protect against atmospheric corrosion is greatly reduced. Third, since the pickle oil provides the lubricant in the first stand of a cold rolling mill, the loss of the lubricating oil by dripping will have to be replaced by another lubricant. Similar disadvantages are observed in the slushing oils in use today.

SUMMARY OF INVENTION

I have now discovered a process that converts pickle oils, slushing oils and oily lubricants used for drawing and stamping operations into non-dripping coatings on steel. This process provides for the inclusion of at least one long chain linear alcohol in the oils at elevated temperatures. The base oils for the pickle oil, slushing oil and oil based lubricants are hydrocarbon oils. The long chain alcohols are selected from the group of $C_{18}$ to $C_{24}$ linear alcohols. The long chain linear alcohols constitute from about 3 to 30% by weight of the coating mixture of hydrocarbon oil and alcohol.

The process requires that the coating mixture be applied hot to the hot steel and thereafter the coated steel be cooled. A convenient way of cooling is to allow the coil to cool naturally by exposure to the surrounding air. At a temperature above ambient, the oily coating mixture becomes a non-dripping meso-solid. This solid coating eliminates the fire and accident hazard heretofore encountered by oil drippings which accumulate on the floor of the steel mill. More importantly, the meso-solid coating significantly increases the corrosion protection of the steel.

Conventional additives for pickle oils, slushing oils, and oils for drawing and stamping may also be included in the coating mixture.

DETAILED DESCRIPTION OF THE INVENTION

The oils which form the base for my non-dripping coating mixture are hydrocarbon oils. These oils are obtained as distillates from naphthenic, paraffinic and aromatic crude oils and mixtures thereof. The oils will range in viscosity from 90 to 300 S.U.S. at 100° F. The boiling range of the oils will generally be in the range of about 400° F. to 700° F.

Distillates derived from naphthenic crudes are generally preferred since they are cheaper than the paraffine or aromatic crudes. In addition, the naphthenic crude distillates are more clean burning than the aromatic based oils. Mixtures of the various oils are also suitable.

Typical mineral oils useful in my coating compositions derived from naphthenic crude will have a viscosity of 90 to 300 S.U.S. at 100° F. and a boiling range of 400° to 700° F. The preferred oils for use in my process are pickle oils, slushing oils and drawing oils. Other suitable base oils are gear oils, machine oils and cutting oils derived from hydrocarbons. The hydrocarbon oil will comprise about 50 percent to about 96 percent by weight of the coating mixtures.

The long chain linear alcohols which are added to the hydrocarbon oils in my process of coating steel are the $C_{18}$ to $C_{24}$ linear alcohols, particularly the primary alcohols. However, secondary alcohols can also be used. It doesn't matter whether the alcohol chains are saturated or unsaturated as either type can be used in my process. Typical alcohols in the $C_{18}$ to $C_{24}$ range which are useful in my process are stearyl alcohol, oleyl alcohol, 1-eicosanol, behenyl alcohol, erucyl alcohol, carnaubyl alcohol and mixtures thereof. These alcohols are commercially available.

My preferred alcohol is behenyl alcohol, $CH_3(CH_2)_{20}CH_2OH$.

The alcohols are used in the hydrocarbon oils at a concentration of about 3 to about 30% by weight of the mixture of hydrocarbon oil and alcohol. Since most of these alcohols are solids at ambient temperature, it is necessary to heat the oil or melt the alcohol so that the alcohol can be uniformly dispersed in the hydrocarbon oil. This is conveniently done by adding the required amount of alcohol to the hot hydrocarbon oil while stirring. Heating the oil to about 160° to 200° F. is sufficient to melt the alcohol and disperse it in the hydrocarbon oil.

The coating mixture of alcohol and hydrocarbon oil is applied hot; that is, at a temperature in excess of 150° F. to steel which has also been previously heated to a temperature in excess of 150° F. Preferably the temperatures are in the range of 151°–200° F. for both the coating mixture and steel.

The steel is contacted with the coating mixture by running the metal through a tank of the coating mixture or by applying the coating mixture by roller coating, spraying, flooding or any other convenient method.

After the coating mixture of alcohol and hydrocarbon oil is applied to the steel, the steel is allowed to cool gradually to ambient temperatures by natural conduction and convection or by forced air cooling. As the steel cools to about 145° F. and lower polygonal crystals form on the surface of the steel. These pyramidal crystals capture the oil and convert the liquid oil coating mixture into a meso-solid. At this point, the flow properties of the hydrocarbon oil are completely hindered, flow stops abruptly and dripping of the oil does not occur.

The coating mixture of long chain linear alcohol and hydrocarbon oil usually contains one or more additives normally encountered in pickle oils, slushing oils, stamping oils and drawing oils. Typical additives are surface active agents for wetting surfaces and dispersing and emulsifying soil, E. P. additives, anti-wear additives, anti-oxidants, perfumes, rust preventatives, germicides and foam control agents. These additives are used at a concentration ranging from about 0.005 to 20.0 percent by weight of the mixture. The surface active agents are well known in the art and may be selected from McCutheon's Detergents and Emulsifiers, 1978 edition, which is incorporated by reference.

E. P. additives when desired may be selected from the group consisting of molybdenum disulfide, polymers of 1,2,4-thiadiazole-dithiols, sodium molybdate, complex antimony sulfides and graphite. Corrosion inhibitors include alkali metal nitrates, alkali metal nitrites and benzotriazole. A typical germicide is Dowicide 75 and sodium omadine. Foam control agents may be the linear paraffinic $C_8$–$C_{12}$ alcohols. Typical anti-wear agents are aluminum complex grease, clay grease, silicone grease, lithium grease and yellow grease.

The best mode of practicing my invention will be evident from a consideration of the following examples.

EXAMPLE 1

Steel strip continuously emerges from a hot rolling mill at a speed of about 500 feet per minute. The steel strip is then directed through a mechanical scale remover and while still hot is directed through a sulfuric acid pickling bath held at 160° to 180° F. Immersion time in the pickle tank is about 2 to 3 seconds. After leaving the pickle tank, the steel strip is rinsed twice with hot water and is then passed through a hot air dryer. In the hot air dryer, a blast of hot air literally blows the water off the surface of the steel strip. Any residual water is evaporated by the heat in the steel which will be at a temperature in the range of about 151° to 200° F.

The steel strip is then directed to the pickle oil station where the steel is contacted with a pickle oil coating mixture having a hydrocarbon oil base. The coating mixture will be held at a temperature in excess of about 150° and is generally in the range of about 151° to 180° F. The pickle oil coating mixture has been previously prepared in a separate formulating tank and then it is pumped into the pickle oil coating storage tank.

The pickle oil coating mixture is continuously circulated by pump from the coating tank to a flooding station directly over the tank. At the flooding station, the hot strip is contacted with an excess of oily coating mixture which excess then drains back into the coating storage tank. Take up rolls regulate the amount of coating mixture retained on the steel strip. Preferably, the pickle oil coating mixture is held at a temperature in the range of about 160° to 180° F.

The pickle oil coating mixture is prepared according to the following formula, all percentages being by weight.

| | |
|---|---|
| Mineral oil (Naphthenic 300 S.U.S. 100° F.) | 73.3% |
| Behenyl alcohol (technical) | 5.0% |
| Emulsifier | 1.43% |
| Foam Control Agent | 0.005% |
| Pine Oil (perfume) | 0.005% |
| Deodorant (perfume) | 0.005% |
| Germicide | 0.005% |
| Antioxidant | 0.050% |
| Phos-amine (E.P. additive) | 4.7% |

-continued

| | |
|---|---|
| Yellow Grease | 15.5% |
| | 100.0% |

The pickle oil has a flash point of about 405° F., an acid number of 13.5 and a viscosity of 250 S.U.S. at 100° F.

The coated steel strip is allowed to cool to amient temperature while it is being recoiled. As soon as the temperature drops below 150° F., the coating mixture converts to a non-dripping, corrosion resistant meso-solid. The recoiled strip is then transferred to the cold rolling mill or to a finishing operation.

EXAMPLE 2

The steel strip as it leaves the cold rolling mill is coated with a slushing oil in the same manner as the pickle oil is applied in Example 1. The slushing oil has the following composition, all percentages being by weight:

| | |
|---|---|
| Mineral oil (naphthenic base) 300 S.U.S. at 100° F.– | 78% |
| Behenyl alcohol (Technical) | 15% |
| Germicide - Dowicil | .005% |
| Pine Oil | 0.05% |
| Yellow Grease | 6.8% |
| Surfactant | 0.1% |

After the coating is applied to the steel strip, the strip is recoiled for transfer to manufacturing operations or to storage.

I claim:

1. A process for converting a corrosion resistant oily coating mixture for steel into a meso-solid coating on steel in order to increase resistance to atmospheric corrosion comprising contacting the steel while it is at a temperature in excess of about 150° F. with an oily coating mixture previously heated to in excess of about 150° F. consisting essentially of a hydrocarbon base oil and from about 3 to 30 percent by weight of the mixture of at least one linear alcohol of $C_{18}$ to $C_{24}$ content and thereafter cooling the coated steel thereby converting the oil coating mixture into a meso-solid coating on steel.

2. The process of claim 1 in which the linear alcohol is behenyl alcohol.

3. The process of claim 1 in which the linear alcohol is present at a concentration of 5 to 10 percent by weight of the oily coating mixture.

4. The process of claim 1 in which the hydrocarbon oil is a pickle oil.

5. The process of claim 1 in which the hydrocarbon oil is a slushing oil.

6. The process of claim 1 in which the coating mixture contains from 0.005 to 20 percent by weight of one or more additives selected from the group consisting of surface active agents, E. P. additives, anti-wear additives, rust preventatives, germicides, anti-oxidants, perfumes and foam control agents.

* * * * *